United States Patent [19]

Tompa et al.

[11] 4,389,265

[45] Jun. 21, 1983

[54] BREAKDOWN OF SOLID PROPELLANTS AND EXPLOSIVES, RECOVERY OF NITRAMINES

[75] Inventors: Albert S. Tompa, Indian Head, Md.; David M. French, Alexandria, Va.; Billy R. White, Oxon Hill, Md.

[73] Assignee: The United States of America as represented by the Secretary of the Navy, Washington, D.C.

[21] Appl. No.: 283,709

[22] Filed: Jul. 16, 1981

[51] Int. Cl.[3] ..... C06B 45/10

[52] U.S. Cl. ..... 149/109.6; 149/92; 149/124; 264/3 R

[58] Field of Search ..... 149/19.92, 109.6, 92; 264/3 R; 142/124

[56] References Cited

U.S. PATENT DOCUMENTS

| | | | |
|---|---|---|---|
| 3,909,497 | 9/1975 | Hendry et al. | 149/19.4 |
| 4,018,636 | 4/1977 | O'Neill et al. | 149/19.92 |
| 4,057,442 | 11/1977 | Shaw et al. | 149/19.92 |
| 4,098,627 | 7/1978 | Tompa et al. | 149/109.6 |
| 4,229,182 | 10/1980 | Frosch | 149/19.92 |
| 4,293,352 | 10/1981 | Lee et al. | 149/92 |

*Primary Examiner*—Edward A. Miller

*Attorney, Agent, or Firm*—R. S. Sciascia; A. L. Branning; R. D. Johnson

[57] ABSTRACT

Processes for reclaiming nitramines from propellants by dissolution of the crosslinked propellant binder by heating the propellant with either (1) a mixture of 2-aminoethanol, an aromatic solvent, and optionally a second low molecular weight alcohol, or (2) a mixture of a mineral acid (HCl, $H_2SO_4$, and $H_3PO_4$, but not $HNO_3$), a organic solvent which is acetone, methyl ethyl ketone, ethylene glycol monomethyl ether, tetrahydrofuran, or mixtures thereof, and water.

8 Claims, No Drawings

BREAKDOWN OF SOLID PROPELLANTS AND EXPLOSIVES, RECOVERY OF NITRAMINES

BACKGROUND OF THE INVENTION

This invention relates to a method of dissolution of pyrotechnic materials containing cured or crosslinked organic polymers as binders.

Every year, large amounts of pyrotechnic materials must be disposed of due to deterioration or obsolescence. In the past, pyrotechnics have been disposed of by dumping them in the ocean, burning them in an open area, or detonating them in a safe zone. Viewed from an ecological standpoint these methods are undesirable because they contribute to contamination of the ocean and to pollution of the atmosphere by releasing corrosive hydrogen chloride gas and noxious oxides of nitrogen into the air. Because of concern over minimizing all sources of environmental pollution, the need exists for an ecologically sound alternative method for disposing of unwanted pyrotechnic materials.

In addition to being inexpedient from an ecological standpoint, the previous methods of disposal are unsatisfactory from an economic point of view. The utter waste of valuable raw materials which are used in the preparation of pyrotechnic materials is readily apparent when methods such as those mentioned above are employed for the disposal of these items. Accordingly, it would be desirable to develop a process whereby some or all of the components which make up the pyrotechnic materials could be recovered and reused.

Several methods have been proposed in the prior art for the decomposition of polymeric materials. One such method involves heating polyurethanes in the presence of the polyol used to prepare the original polymer, as disclosed by Ten Broeck in U.S. Pat. No. 2,937,151. Other methods involve heating polyurethanes in the presence of a primary amine, as disclosed by McElroy in U.S. Pat. No. 3,117,940, or heating polyurethanes in the presence of an amine in combination with a strong base, as disclosed by Matsudaira et al in U.S. Pat. No. 3,404,103. More recently, Frulla et al have described a process for the decomposition of scrap polyurethane foam by heating in the presence of a mixture of an eliphatic diol and a dialkanolamine. Some of the above described prior art methods do not provide for recovery of the chemical components of the decomposed polymeric material, while others utilize some combination of high temperature, high pressure or high alkali concentration, which conditions are not compatible with the recovery of pyrotechnic materials components due to their instability.

Tompa et al in U.S. Pat. No. 4,098,627 disclose methods by which a pyrotechnic material containing a cured polymeric binder is decomposed under much milder conditions so that many of the starting materials can be recovered. The method involves heating the pyrotechnic material to a temperature of from about 50° C. to about 160° in a liquid medium comprising an active hydrogen containing compound capable of cleaving the chemical bonds contained in the polymeric binder. One or more of the products resulting from the decomposition of the pyrotechnic material can be separated and recovered. The active hydrogen containing compounds included primary amines, secondary amines, ammonia, mineral acids and water. Unfortunately, the alkaline processes (amines and ammonia) destroyed any nitramines present. The use of mineral acids and water resulted in some recovery of nitramine, but the yields were very low (e.g., 36%). Because nitramines are expensive it would be desirable to find a method of recovering them in high yield (i.e., 80% or more).

SUMMARY OF THE INVENTION

Accordingly, it is an object of this invention to provide a method of recovering nitramines in high yield from pyrotechnic materials having polymeric binders.

Another object of this invention is to provide a safe and ecologically sound method of disposing of pyrotechnic materials.

These and other objects of this invention are accomplished by providing an improved method of dissolution of pyrotechnic materials having polymeric binders comprising either the use of: (1) a solution of 2-aminoethanol in an aromatic solvent-alcohol mixture or (2) a solution of a mineral acid, water, and an organic solvent selected from the group consisting of acetone, methyl ethyl ketone, ethylene glycol monomethyl ether, tetrahydrofuran, and mixtures thereof.

DETAILED DESCRIPTION OF THE PREFERRED EMBODIMENT

The processes of the present invention provide means by which nitramines may be salvaged from pyrotechnic materials having cross-linked binders. One of the processes uses 2-aminoethanol (ethanolamine) as an active hydrogen containing compound to breakdown or dissolution the polymeric binder. The remaining processes use mineral acids for this purpose.

A solution of 2-aminoethanol in an alcohol-aromatic solvent mixture is used. The concentration of 2-aminoethanol is from 0.5 N to 8.0 N, but preferably from 1.0 N to 3.0 N. Alcohols which are used include ethanol, 1-propanol (n-propanol), 2-propanol (isopropanol) and mixtures thereof. Of these 2-propanol is preferred. Any conventional aromatic solvent may be used. Examples include benzene, toluene, xylene, ethyl benzene, an diethylbenzene. Xylene and diethylbenzene include their ortho, meta and para isomers and mixture thereof. The volume percent of alcohol in the alcohol-aromatic solvent mixture is from zero to 60, and preferrably from 40 to 60, with the aromatic solvent constituting the remainder of the mixture.

The pyrotechnic material is put into the 2-aminoethanol-alcohol-aromatic solvent solution which is held at a temperature in the range of from 15° C. to 80 C., but preferably at from 40° C. to 80° C. This is continued until the pyrotechnic material has been broken down and the binder material disolved.

A solution of a mineral acid in a water-organic solvent mixture may also be used. The mineral acid may be HCl, $H_2SO_4$, or $H_3PO_4$, but HCl is preferred when a metal is present in the propellant. The concentration of the acid should be from 2.0 N to 6.0 N, but preferably from 3.0 N to 5.0 N. Organic solvents which may be used are limited to acetone, methyl ethyl ketone, ethylene glycol monomethyl ether, tetrahydrofuran, or mixtures thereof. Acetone is preferred if nitroglycerin or another material which is water immiscible but organic solvent soluble is present. The volume percent of the organic solvent in the water-organic solvent mixture is from more than zero to 60 and preferably from 40 to 60, with water constituting the remainder of the mixture. The lower volume percentages of organic solvent can be used where the crosslink density of the binder is low.

The pyrotechnic material is put into the acid-water-organic solvent solution which is held at a temperature in the range of from 15° C. to 80° C., but preferably at from 40° C. to 80° C. This is continued until the pyrotechnic material has been broken down.

If recovery of metals is desired, 2-aminoethanol is preferred over the mineral acids as the active agent when metals are present in the pyrotechnic material. Acids react with the metals, but 2-aminoethanol does not.

After the dissolution of the pyrotechnic material is completed in both the 2-aminoethanol and the mineral acid process, the nitramine is present as a solid. If a metal was also present in the pyrotechnic material and the 2-aminoethanol process was used, the metal will also be present as a solid. In this case the metal and nitramine are separated from the liquid phase by conventional techniques such as filtration. The nitramine is then extrated in acetone and then water is added to the acetone to precipitate the nitramine. Otherwise, when the nitramine is the only solid present, it is simply filtered out and washed.

The general nature of the invention having been set forth the following examples are presented as specific illustrations thereof. It will be understood that the invention is not limited to these specific examples but is susceptible to various modifications that will be recognized by one of ordinary skill in the art.

Table 1 shows the propellant stocks which were used in the tests of examples 1–6. Table 2 presents the composition of solvents used in examples 1–6 to break down the stocks to recover the nitramines.

TABLE 1

| Stock No. | Binder System | Fillers | Plasticizer |
|---|---|---|---|
| I | Hydroxyl terminated polyester & polyisocyanate | HMX, Al | NG |
| II | Hydroxyl terminated polyester, N/C, & Polyisocyanate | HMX, Al | NG |
| III | Mixed Acrylate | RDX | |

N/C — nitrocellulose
HMX — cyclotetramethylenetetranitramine
RDX — cyclotrimethylenetrinitramine
Al — Aluminum
NG — Nitroglycerine

TABLE 2

| Preferred Solutions for Breakdown | A | B | C (1) | D (1) | E (1) |
|---|---|---|---|---|---|
| Ethanolamine (2-aminoethanol) | 7.23 | | | | |
| Hydrochloric acid solu., 37% (2) | | 41.2 | 40.9 | 37.7 | 39.3 |
| Toluene | 48.1 | | | | |
| Isopropanol (3) | 44.7 | | | | |
| Acetone | | 41.4 | | | |
| Methyl ethyl ketone | | | 41.8 | | |
| Ethylene glycol monomethyl ether | | | | 46.3 | |
| Tetrahydrofuran | | | | | 44.2 |
| Water | | 17.4 | 17.3 | 16.0 | 16.5 |
| Conc. active ingredient, mols/l | 1.0 | 4.0 | 4.0 | 4.0 | 4.0 |
| Density, gms/ml | 0.846 | 0.956 | 0.963 | 1.043 | 1.005 |

(1) These solutions separate into two phases in the presence of nitroglycerin
(2) In the absence of metals (Al, etc.), $H_2SO_4$ or $H_3PO_4$ may also be employed
(3) Ethanol and n-propanol are also effective.

EXAMPLE 1

Two pounds (906 gms) of Stock I, Table 1, containing tetramethylenetetranitramine (HMX), aluminum powder, and nitroglycerin were cut into small pieces and extracted three times with methylene chloride to remove most of the nitroglycerin. The dry stock was placed in 2718 gms (3213 ml) of Solution A, Table 2, which is a 1.0 molar solution of ethanolamine (2-aminoethanol) in an equivolume mixture of toluene and isopropanol. The treatment was carried out in a five liter resin flask equipped with a three-neck cover for air-stirrer, condenser, and nitrogen purge. The flask was immersed in a water bath. After stirring for six hours at 60° C. the lumps of stock had disappeared. During the reaction the temperature of the solution was the same as that of the water bath so the reaction was not strongly exothermic.

The liquid in the flask was decanted into a container partially filled with water and discarded. The remaining slurry of finely divided HMX and aluminum was washed twice with methylene chloride and extracted with acetone at 40° C. to dissolve out the HMX. The resulting solution of HMX was poured into an excess of water and filtered to remove the precipitated HMX. The HMX was washed with ethanol and dried. The yield based on the amount known to have been mixed into the original stock was 87%. The aluminum powder was washed with acetone and dried. The yield of recovered aluminum powder was 99%.

At 18° C. the degradation reaction was found to require 48 hours rather than the 6 hours at 60° C.

EXAMPLE 2

Some of Stocks I and II, Table 1, were extracted with methylene chloride to remove most of the nitroglycerine. Stock II differed from Stock I in containing nitrocellulose whose extra hydroxyl groups increased the effective crosslink density. Varying quantities of Stocks I and II before and after extraction were added as ¼ inch cubes to 100 ml. of Solution A, Table 2 and allowed to degrade at 15° C. Amounts of stocks used were 5, 10, 20, and 30 gms. Samples of 30 gms were also at 60° C. All the samples degraded. Time to breakdown is shown in Table 3.

TABLE 3

Time to Breakdown in Amine Solution as a Function of Sample Size and Temperature*

| Stock | Concentration, gms/100 ml Solution A | Time to Breakdown at 15° C. | Time to Breakdown at 60° C. |
|---|---|---|---|
| Stock I | 5 | 3 days | |
| | 10 | 4 | |
| | 20 | 7 | |
| | 30 | | 16 hrs. |
| Stock I extracted** | 5 | 3 days | |
| | 10 | 3 | |
| | 20 | 3 | |
| | 30 | 4 | 6 hrs |
| Stock II | 5 | 4 days | |
| | 10 | 5 | |
| | 20 | 8 | |
| | 30 | | 20 hrs. |
| Stock II extracted** | 5 | 4 days | |
| | 10 | 5 | |
| | 20 | 6 | |
| | 30 | 6 | 8 hrs. |

*The amount of sample was varied but each sample was in ¼ inch cubes
**extracted with methylene chloride to remove most of the nitroglycerin Quantitative determinations of 2-aminoethanol were made during the reactions. It was found that the 2-aminoethanol concentration decreased with time. The decrease was proportional to the amount of stock originally present and was much greater for the as-received stocks than for the extracted ones.

It was concluded that the dissolution reaction was dependent on the concentration of 2-aminoethanol and hence was faster for the extracted stocks since these contained less nitroglycerin which reacted with and consumed 2-aminoethanol. The reaction was slower when the larger amounts of stock were present probably because these contained more nitroglycerin. The samples containing nitrocellulose had a higher crosslink density and also required a longer time for breakdown.

EXAMPLE 3

One part by weight of Stock I, Table I, was added to three parts by weight of solution B, Table II, a 4.0 N solution of HCl in water and acetone. The sample container was equipped with a reflux condenser and placed in a water bath at 75° C. Hydrogen was evolved from the reaction of acid with aluminum in the sample so the reaction vessel had been swept with nitrogen before raising the temperature. The HCl-Al reaction released heat and the interior of the lumps of stock was certainly at a higher temperature than the solution around it. Because of the heat resistance of nitramines, the increased temperature was not considered a hazard. Dissolution was complete in three hours.

The resulting mixture contained a liquid with powdered HMX at the bottom. The liquid layer was decanted off and the HMX washed twice with water, once with a small proportion of acetone, twice with methanol, and dried. The solids were identified as HMX in the beta crystalline form. An 85% yield of the HMX originally present in the stock was obtained. Repetition of the work gave yields up to 94%. Photomicroscopy showed that the particle size of the recovered HMX was essentially the same as when it was originally introduced into the stock. Since a large part of the cost of a filler can be attributed to grinding to a proper particle size, this last is an important point and offsets the loss of the metallic aluminum powder inherent in an acidic process.

EXAMPLE 4

The work described in Example 3 was repeated except that the material dissolved was Stock II, Table I. The liquid layer was decanted from the mixture and discarded. The remaining HMX was washed with a small proportion of acetone to remove nitrocellulose from the crystals, then washed twice with methanol and dried.

EXAMPLE 5

The effect of various water miscible organic solvents on the acidic breakdown of Stock I, Table I, was investigated. See Table IV.

TABLE 4

Effect of Water-Miscible Organic Solvents on Disintegration in Acid

| | F | G | H | I | J | K | L |
|---|---|---|---|---|---|---|---|
| HCl, 37% Soln. in water, ml. | 10 | 10 | 10 | 10 | 10 | 10 | 10 |
| Water, ml | 5 | 5 | 5 | 5 | 5 | 5 | 5 |
| Tetrahydrofuran, ml. | 15 | | | | | | |
| Dioxane, ml. | | 15 | | | | | |
| Acetone, Ml. | | | 15 | | | | |
| Ethylene glycol monomethyl ether, ml. | | | | 15 | | | |
| Ethylene glycol dimethyl ether, ml. | | | | | 15 | | |
| Diethylene glycol dimethyl ether, ml. | | | | | | 15 | |
| Methyl ethyl ketone, ml. | | | | | | | 15 |
| Approx. Initial boiling pt., °C. | 73 | 90 | 65 | 100 | 85 | 99 | 75 |
| No. of liquid phases, 25° C. to boiling pt. | 1 | 1 | 1 | 1 | 1 | 1 | 1 |
| No. of liquid phases, 1 g. Stock I | 1 | 1 | 1 | 1 | 1 | 1 | 1 |
| No. of liquid phases, 10 g. Stock I | 2 | 2 | 1 | 2 | 2 | 2 | 2 |
| Time to disintegration, 1 g. at 75° C., hrs. | 3 | 3 | 2 | 1.5 | 1 | 6 | 3 |
| Order of increasing HMX solubility | 1 | | 3 | 2 | 1 | | 2 |
| Recovery of HMX, %, 1 g. Stock I | 98 | 36 | 85–94 | | | | |

It is desirable that the solvents swell the stock binder, form a single liquid phase with water and any extract and decomposition products from the stock, and dissolve a minimum of HMX. Nitroglycerin present in Stock I is not miscible with water and two liquid phases formed for all the solvents used except acetone when one part of Stock I was placed in three volumes of HCl-organic solvent mixture. HMX dissolves in acetone to a greater degree than in the other solvents employed but the present of water decreased the solubility to such an extent that a high yield of HMX was obtained. In the absence of nitroglycerin the other solvents were acceptable. However, from the point of view of availability, low HMX solubility, and stock breakdown-time methyl ethyl ketone, tetrahydrofuran, or ethylene glycol monomethyl ether were the most suitable alternatives to acetone. See Table 2, Solutions C, D, and E.

Mineral acids other than HCl were investigated for use in the acid breakdown method. When aluminum was present, voluminous deposits of aluminum salts formed when economically feasible proportions of stock were used which made the method impractical. In the absence of metals, $H_2SO_4$, and $H_3PO_4$ are suitable in Solutions B, C, D, and E of Table II.

EXAMPLE 6

One part by weight of Stock III, Table 1 (a mixed acrylate binder with cyclotrimethylenetrinitramine, RDX, as a filler), was added to three parts by weight of solution A, Table 2 (1.0 molar 2-aminoethanol in an equivolume mixture of toluene and isopropanol). Another part by weight of Stock III, Table 1, was added to three parts by weight of solution B, Table 2 (a 4.0 N solution of HCl in water and acetone). The sample with Solution B was equipped with a reflux condenser. The first sample was heated at 60° C. Disintegration was complete in one hour. The second was heated at 75° C. and required two days for complete breakdown. The liquid was decanted from the first sample and discarded. The RDX remaining was washed with three parts of toluene, then with three parts of methanol, and dried. A 98% yield of RDX was recovered based on the original amount mixed into Stock III.

While the present processes may be used to recover nitramines in general, they are preferably used to recover cyclotrimethylenetrinitramine, cyclotetramethylenetetranitramine, nitroquanidine, ethylene dinitramine, 2,4,6-trinitrophenylmethylnitramine, or mixtures thereof, and more preferably cyclotrimethylenetrinitramine or cyclotetramethylenetetranitramine.

Obviously many modifications and variations of this invention are possible in light of the above teachings. It is, therefore, to be understood that within the scope of the appended claims the invention may be practiced otherwise than as specifically described.

What is claimed as new and desired to be secured by Letters Patent of the United States is:

1. A process for reclaiming a nitramine in high yield from a pyrotechnic material having a chemically cross-linked binder component selected from the group consisting of polyurethanes, polyamides, polyesters, and polyacrylates, which comprises the steps of:

(1) placing the pyrotechnic material into a solution consisting essentially of from about 2.0 N to about 6.0 N of an acid selected from the group consisting of HCl, $H_2SO_4$, and $H_3PO_4$ in an acetone-water solvent mixture, said solvent mixture consisting essentially of 40 to 60 volume percent acetone and water mixture;

(2) maintaining the mixture resulting from step (1) at a temperature of from about 15° C. to about 80° C. until the binder has been broken down; and (3) isolating the nitramine.

2. The process of claim 1 wherein the concentration of the acids is from 3.0 N to 5.0 N.

3. The process of claim 1 wherein the acid is HCl.

4. The process of claim 1 wherein the nitramine is selected from the group consisting of cyclotrimethylenetrinitramine, cyclotetramethylenetetranitramine, nitroguanidine, ethylene dinitramine, 2,4,6-trinitrophenylmethylnitramine, and mixtures thereof.

5. The process of claim 4 wherein the nitramine is cyclotrimethylenetrinitramine.

6. The process of claim 4 wherein the nitramine is cyclotetramethylenetetranitramine.

7. The process of claim 3 wherein the concentration of HCl is from 3.0 N to 5.0 N.

8. The process of claim 3 wherein the temperature used in step (2) is from 40° C. to 80° C.

* * * * *